United States Patent [19]

Sornes

[11] 4,452,059

[45] Jun. 5, 1984

[54] LOCK APPARATUS

[75] Inventor: Tor Sornes, Moss, Norway

[73] Assignee: Elkem a/s, Oslo, Norway

[21] Appl. No.: 285,765

[22] Filed: Jul. 22, 1981

[30] Foreign Application Priority Data

Aug. 8, 1980 [NO] Norway ..... 802386

[51] Int. Cl.[3] ..... E05B 25/00; E05B 47/00

[52] U.S. Cl. ..... 70/278; 70/352

[58] Field of Search ..... 70/352, 277, 278, 276, 70/279, 280, 281, 282; 361/172; 340/149 R

[56] References Cited

U.S. PATENT DOCUMENTS

| | | | |
|---|---|---|---|
| 3,611,763 | 10/1971 | Sedley | 70/276 |
| 3,733,862 | 5/1973 | Killmeyer | 70/277 |
| 4,090,175 | 5/1978 | Hart | 70/278 |
| 4,149,394 | 4/1979 | Sornes | 70/352 |
| 4,286,305 | 8/1981 | Pilat | 361/172 |

FOREIGN PATENT DOCUMENTS

| | | |
|---|---|---|
| 2258854 | 6/1973 | Fed. Rep. of Germany . |
| 2431497 | 1/1975 | Fed. Rep. of Germany . |
| 2516283 | 10/1976 | Fed. Rep. of Germany . |

*Primary Examiner*—Robert L. Wolfe

*Attorney, Agent, or Firm*—Eyre, Mann, Lucas & Just

[57] ABSTRACT

The present invention relates to a lock system comprising a lock of the type where the combination of the lock is given by a more or less platelike code member which may be removed and substituted and where the lock is operated by means of a more or less platelike key member. The key member is equipped with a code adapted to the code of the code member. The lock comprises a housing and means intended to be activated by the code of the code member and/or the code of the key member, said means reading the codes. Parts of the code on the key member may be read mechanically, using blocking pins while parts of the code may be read optically and/or electronically by means of light diodes emitting infrared light.

10 Claims, 4 Drawing Figures

FIG.1
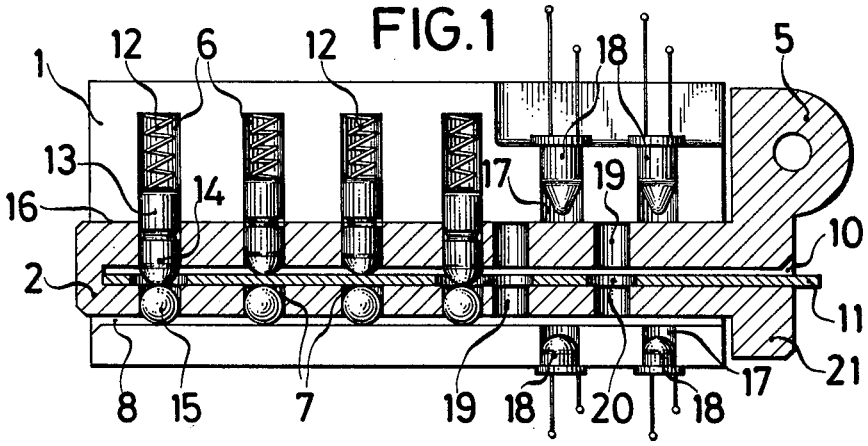
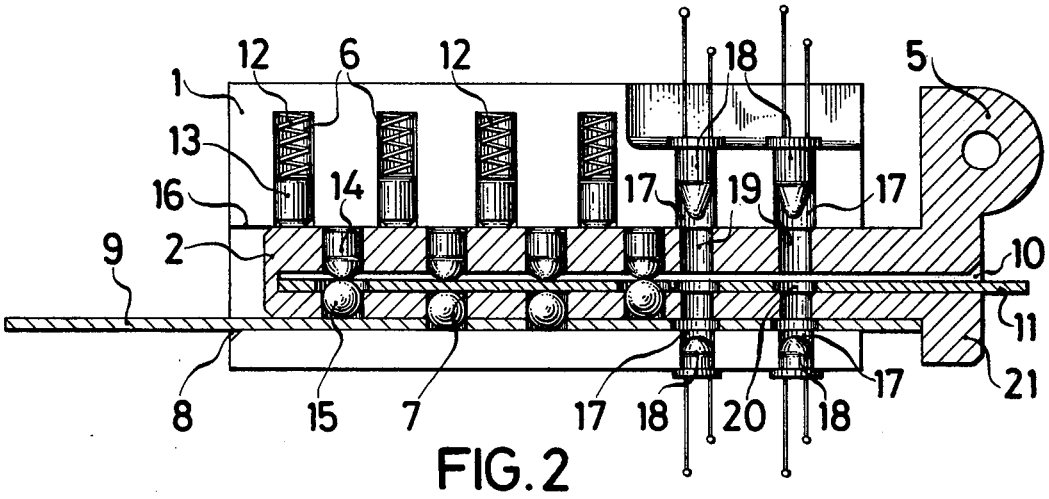
FIG.2
FIG.3
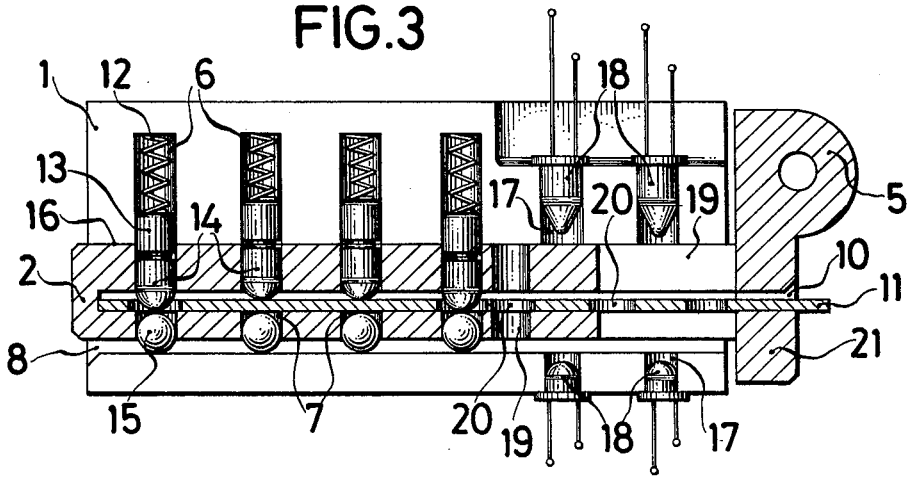

LOCK APPARATUS

The present invention relates to a lock system and a lock assembly of the type where the combination of the lock is determined by a substantially card-like code member which may be removed and/or substituted and where the lock is operated by a substantially card-like key member, equipped with a code adapted to the code of the code member. In particular, but not exclusively, the present invention is suitable for use on automobiles.

The lock comprises a housing in which are arranged means which are activated by the code member and/or the key member. The present invention will now be described and discussed in conjunction with automobiles. It should be appreciated, however, that the present invention is not limited to such use.

Commonly, a lock system for automobiles comprises lock(s) for the doors and/or the trunk. Further, the system incorporates an ignition lock and a lock for the steering wheel. For lock systems of this type, a system is required wherein the various locks may be operated by a single key or by a limited number of different keys. Further, a system wherein one key may operate some of the locks in the system, but not all, is required.

In addition, a system where at least the steering wheel is locked mechanically is required. Further, it is desirable to provide the automobile with a lock system where the key(s) is intended to operate the lock only a limited length of time. It is further desirable with a locking system where certain keys in the system for example will not permit locking of the doors of the vehicle etc.

It has previously been proposed to use a lock comprising a housing, in which is movably supported a locking member for movement between locked and unlocked position. The housing and locking member have aligned bores containing blocking pins supported for movement between a first position in which the locking member is movable relative to the housing and a second position in which the blocking pins block movement of the locking member relative to the housing. The blocking pins are moved axially by means of substantially card-like key member which may be inserted into a traverse slot in the housing. The combination of the lock is determined by a substantially card-like code member which is removably arranged in a second tranverse slot in the housing and which moves the locking pins in axial direction in the respective borings. The correct key member is equipped with a code adapted to the code on the inserted code member.

The blocking pins are thus affected mechanically by the code member and/or the key member. Both the code member and the key member are equipped with bores which are arranged in a predetermined pattern corresponding to a matrix of bores in the housing and the locking means.

The bores of the the key member supplement the bores of the code member so that they together form a complete matrix corresponding to the matrix of bores in the housing and the locking means. By inserting a key member correctly coded with respect to the code member inserted in the housing, the locking effect of the blocking pins will be suspended and the locking means may be moved relative to the housing.

It has further been proposed to use an electronic locking system for automobiles, incorporating microprocessors, where the doors and the ignition system and optionally the steering wheel lock may be activated by means of a solid-state keyboard. In order to activate the various locks of the locking system, the keys on the keyboard are touched or pressed down in the same sequence as the sequence stored in the micro-processor.

The disadvantage with such a system is the complete dependency of supply of current from a current source in order to operate the system. If the current supply fails or the micro-processor for one or other reasons is disconnected from the current supply the code is deleted from the memory, whereby the lock(s) subsequently cannot be activated without having to take special caution. For such type of locking systems, an additional mechanical locking system is required in addition to the electronic system in order to eliminate the disadvantage due to power interruption or failure.

According to the present invention said disadvantages are overcome by a locking system provided with locks where parts of the key member code are read mechanically by means of said blocking pins, while parts of the code are read optically/electronically by means of diodes emitting infrared light or the like. According to one preferred embodiment, the lock comprises a housing, a locking member, blocking pins arranged in borings in the housing and the locking member, the blocking pins being movably arranged in axial direction between two extreme positions where they either prevent or permit movement of the locking member relative to the housing, depending on whether a correct key member is applied or not.

Further, the lock comprises one or more light diodes internally arranged in borings in the housing, said diodes emitting infrared light and being connected to and activating one or more relays etc.

The same code and the same key member may preferably be used for operating both the door lock and the ignition and steering wheel lock of the vehicle. At least the combined ignition and steering wheel lock is of a type where the code is partly read mechanically and partly read electronically. The mechanical part is preferably used for operating the lock on the steering wheel, while the electronically read part is preferably used to activate ignition, light alarms etc. For such type of a locking system a particular key member which only is coded in accordance with the code on the electronically read part should preferably be incorporated, whereby the electrical system of the vehicle could be independently operated.

Further, a separate key which only is intended to operate the mechanical part of the locking system could be incorporated, if desirable.

The optical/electronical reader of the lock should preferably be arranged at the far end of the slot, alternatively at the outer end of the slot or in between the section reading the code mechanically.

According to the present invention, the locking member is provided with one or more bores or openings extending through the locking member. The bores are arranged in the region of the optical/electronical reader unit. Said opening may have such lateral extension that only the key member and/or the code member lies between each pair of diodes in the area of the optical-/electronical reader unit. Alternatively, the locking member may also be arranged between each pairs of light diodes, said locking member being equipped with bores or openings going through the entire locking member. In such a case the key member and/or the code member is equipped with the borings which coincide with one or more borings of the locking member.

One or more units reading the code of the key member optically/electronically may be arranged internally in the housing, said unit(s) being activated only when the key member is completely inserted into the slot, the front end of the member being in contact with the inner end of the corresponding slot of the housing.

The opening(s)/boring(s) of the locking member in the region of the optical/ electronical reading unit may be axially and/or laterally displaced with respect to the corresponding borings for the blocking pins, whereby the blocking effect of the mechanical part of the lock firstly must be suspended and the locking means moved to an open position before the optical/electronical reader unit becomes activated.

According to the present invention different key members based on the same code may be provided for the various locks on the vehicle, the codes varying slightly for example by deleting one or more borings. Dependent on the particular key it is possible to limit the field of application for example to opening of doors or operating only the electronical part etc.

The mechanical part of the lock may for example mechanically activate a latch bolt or similar means, while the electronical part, preferably consisting of diodes, may activate one or more relays.

Alternatively, a time limiting element may be incorporated into the electrical circuit so that a key member will only activate the electrical part a certain, predetermined time from the initial introduction of said key member in a lock. In such a case, the time limiting element may for example be reset by using the original key member. Since the original key member is only in the possession of the proprietor of the vehicle, authorized, but temporary access to the vehicle may be achieved.

According to the present invention diodes emitting infrareed light are preferably used as optical/electronical reading units. Light diodes are a cheap way of achieving a reading effect, since diodes activate relays without being dependent on a micro-processor which is relatively costly in purchasing. The relays may be operated in a simple and none wearing way due to the independency of mechanical contact parts. If the lock is installed in a vehicle door, the lock may be completely covered by the door. For a lock according the present invention, the lock may easily be operated by introducing the cardlike key member into the correct slot in the lock without being dependent on turning any key member. Further, by introducing an alarm system which for example is set off if an incorrect key member is introduced into the lock, unauthorized tampering with the lock system may be prevented.

Further, due to the choice of material, the possibility of downtime due to freezing is reduced. The traverse slot, into which the key member is introduced, may preferably be equipped with a sealing means such as a rubber cuff or the like, thereby preventing dirt etc. from being introduced into the slot.

A preferred embodiment of the present invention will now be described in further detail in conjunction with the figures, wherein:

FIG. 1 shows a section through a first embodiment of a housing according to the present invention, the Figure showing an inserted code member while the lock is in a locked position without having an inserted key member;

FIG. 2 shows a section through the housing shown on FIG. 1 where the key member is also inserted and where the lock is in an open position;

FIG. 3 shows a section through a second embodiment of the housing with an inserted code member, but without having an introduced key member and the lock being in a locked position.

Figure 4:
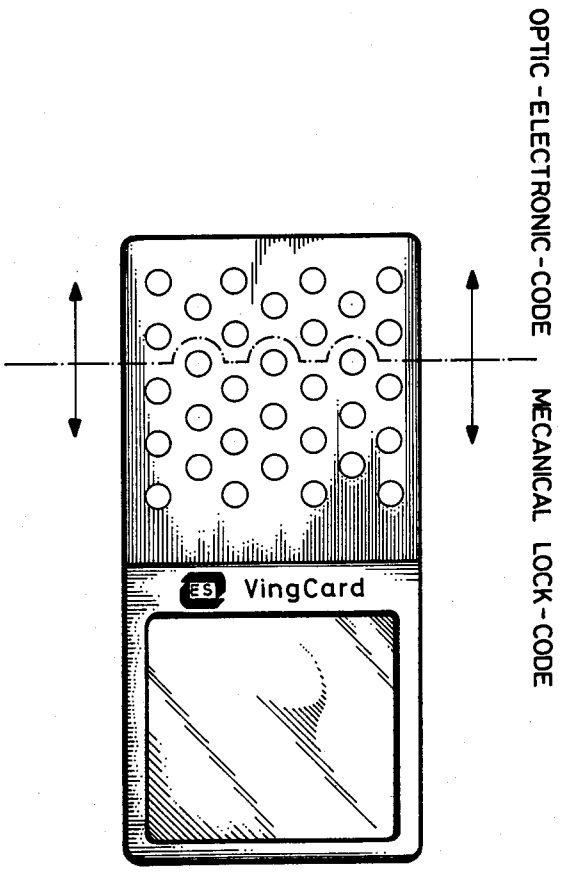
FIG. 4 shows an elevation of the cardlike key member.

FIG. 1 and 2 shows a section through a first embodiment of the housing 3 according to the present invention, the lock shown on FIG. 1 being in a locked position. The housing 3 comprises a stationary part 1 which is intended to be fixed in a slot in a door or the like (not shown). The housing 3 incorporates further a locking means 2 which is slidably arranged in a particularly designed recess or slot 4 in the stationary part 1, enabling the locking member 2 to be moved between two positions, namely a first position where the locking means 2 is in a locked position (FIG. 1) and a second position where the locking member 2 is in an open position (FIG. 2). One end of the locking member 2 is equipped with means 5 intended to co-operate with a locking mechanism (not shown) in order to achieve opening/locking of the lock. The stationary part 1 is equipped with a plurality of dead ended borings 6, arranged in a particular pattern or matrix. The locking means 2 is provided with a plurality of corresponding bores 7 extending through the locking means 2. The bores are arranged in a pattern or matrix corresponding to the matrix on the stationary part 1. The bores 7 terminate in a transverse slot 8 intended for the key member 9, the slot coinciding with the lower separation plane 16 between the locking means 2 and the stationary part 1. The bores 7 are further intersected by a slot 10 in the locking means 2, the slot 10 being intended for the cardlike code member 11. When the locking means 2 is in a locked position (see FIG. 1) the bores 7 of the locking means 2 are coaxially with the corresponding borings 6 in a stationary part 1. Each pair of borings 6, 7 contain a spring device 12 and an upper blocking pin 12 and a lower blocking pin 14. In addition a spherical shaped body 15 is movably arranged in each of the bores 7 in the locking means, the spherical balls 15 being arranged between the lower blocking pin 14 and the stationary part 1. The spherical bodies 15 project down into the slot 8 intended for the key member or up in the slot 10 intended for the code member 11. The diameter of the ball 15, corresponds substantially to the diameter of the boring and corresponds further to the distance between the slot 10 for the code member 11 and the slot 8 for the key member on the locking means 2. The lower blocking pin 14 has a height which together with the thickness of the code member corresponds to the height between the lower surface of the slot 10 and the separation plane 16 between the locking means 2 and the stationary part 1.

When the housing 3 neither contains the code member 11 nor the key member 9, the lower blocking pins 14 will project down into the locking member 2 whereby crossing the separation plane 16 and thus blocking the locking member 3 from moving, cfr. FIG. 1.

The stationary part 1 is further equipped with bores 17 for diodes/light diodes 17. The borings 17 are preferably extending through the stationary part, across the transverse slot 4 for the locking means 2. A first set of light diodes are arranged in borings 17 on one side of the slot 4, while the other set of bores 18 are arranged in the corresponding coaxial borings 17 on the opposite side of the slot 4. The locking member 2 is equipped with borings 19 extending through the locking means 2. According to the embodiment shown on FIG. 1 and 2, these borings are arranged in dispaced with respect to the corresponding borings 7 for the blocking pins, whereby the borings 19 do not become co-axially with the borings for the light diodes 18 until the locking means 2 is in the open, unlocked position such as shown on FIG. 2. In this position, the electric circuits (now shown) are activated by means of conventional connection means and/or relays (not shown). When the locking means 2 is in a locked position, however, there is no contact between the diodes 18 in each pair, the locking means preventing such light contact. Consequently, the electrical circuits will not be acctivated in this position.

According to the present invention, the code member 11 and the key member 9 are equipped with holes 20 which are arranged in a matrix corresponding to the matrix of the borings 7 of the locking means 2 and the housing 3. The holes of the key card supplement the holes of the code card so that these together form a complete matrix, i.e. the key card has holes where the code card does not have holes and vice versa. By introducing the code card 11 in a slot 10, those of the pins 14 which do not fall together with the holes 20 in the code card 11 are lifted such that their separation line between the lower pins 14 and the upper pins 13 coincide with the common separation surface 16. Those pins 14 which coincide with the holes in the code member 11 will still be in their locking position.

If then the correctly coded key card 9 is introduced into the slot 8, the remaining blocking pins 14 will be lifted such that the separation surface between the remaining lower pins 14 and the upper pins 13 coincide with said separation surface 16. Such position is shown on FIG. 2. The locking means 2 may now be moved axially with respect to the stationary part 1. The locking means 2 may consequently activate for example the latch bolt or the like (not shown).

By moving the locking means 2 axially in the direction of the key member 9, the holes 19 for the light diodes 18 in a locking means 2 will become co-axially with the light diodes 18, whereby the light preventing function of the locking means 2 is suspended so that light contact between each pair of diodes is achieved. This light contact activates the various electrical circuits (not shown).

It is apparent that by varying the position of the diodes in a total matrix, it is possible to activate one or more pairs of light diodes whereby the area of use for various key members be varied/limited for one and the same lock. In such a case the code for the mechanical part in a particular system may for example be kept constant while the code for the optical/electronical part for each member holes with respect to the code member, whereby a limited area of use for each key member is achieved.

At the far end of the slot 8 for the key member 9, the locking member 2 may further be equipped with thrust member(s) 21. These may preferably be given such dimensions that the thrust member 21 breaks off in case where a card or a similar element by crude pressure is forced into the slot 8 for the purpose of unauthorized opening of the lock by force.

FIG. 3 shows a second embodiment of the housing 3 according to the present invention. The only major difference between this embodiment and the embodiment shown on FIG. 1 and 2 is the design of the locking member 2. According to the embodiment shown on FIG. 3, at least one pair of light diodes is arranged and placed in such a way that a hole 19 must be present on both the code member 11 and the key member 9 and the position of the hole 19 in the matrix, must be correct in order to achieve the other light diodes.

By means of such type of diodes, a lock system may be provided which will not activate the electrical circuits until the mechanical locking is suspended, the activation of the circuit(s) being dependent upon the presence of and correct placing of certain holes in the locking means 3 and on the key and code members.

FIG. 4 shows as an example a plateformed key member 9 incorporating 32 hole positions, out of which twentyone holes may form a part of the code for the mechanical lock, while eleven may form part of the code for the electronical reading unit.

Locks according to the present invention may be means of a micro-processor and a keyboard be made so that the electronically/optically read part of the code may be converted by means of the correct key member and the keyboard, whereby at least sections of the code combinations may be changed/altered by means of electric keyboard code without really having to change the mechanical key. In such a case the operator will be independent of a particular code for the electronic part of the lock.

According to the embodiment shown, the locking means 2 is equipped with holes extending through the locking means in the region of the electronic part. It should be appreciated, however, that the locking means in this area may be equipped with one, two or a limited number of open elongate slots instead of said holes, the key member and optionally the code member serving as means for allowing/limiting the light contact of the light diodes.

I claim:

1. In a lock comprising mechanical and electro-optical control means which are selectively controllable:

(a) the mechanical control means comprising a plurality of pins in a housing operable to a disabling position upon insertion into said housing of a card-like code member of a predetermined thickness having a particular pattern of holes therein and operable to an enabling position by insertion into said housing of a second card-like key of the same predetermined thickness having a complementary pattern of holes therein;

(b) the electro-optical control means comprising at least one pair of spaced aligned diodes in said housing, said diodes being in a disenabled position when they are not in alignment with a hole in said card-like code member being in an enabled position only when they are in alignment with a hole in said card-like code member and a hole in said card-like key member.

2. The lock of claim 1 wherein there are at least two pairs of spaced aligned diodes, any combination of which is selectively enableable depending on whether or not a particular pair of diodes is in alignment with a hole in each of said card-like code member and card-like key member.

3. The lock of claim 1 wherein the pair of spaced diodes operate on infrared light.

4. The lock of claim 1 wherein the mechanical control means must be enabled before the electro-optical control means can be enabled.

5. The lock of claim 1 wherein the electro-optical control means can be enabled without enabling the mechanical control means.

6. The lock of claim 1 wherein one or more of said holes are slots.

7. The lock of claim 2 wherein the pair of spaced diodes operate on infrared light.

8. The lock of claim 2 wherein the mechanical control means must be enabled before the electro-optical control means can be enabled.

9. The lock of claim 2 wherein the electro-optical control means can be enabled without enabling the mechanical control means.

10. The lock of claim 2 wherein one or more of said holes are slots.

* * * * *